US010960686B2

(12) United States Patent
Ohnishi

(10) Patent No.: US 10,960,686 B2
(45) Date of Patent: Mar. 30, 2021

(54) PRINTING APPARATUS

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 16/519,024

(22) Filed: Jul. 23, 2019

(65) Prior Publication Data

US 2020/0047524 A1 Feb. 13, 2020

(30) Foreign Application Priority Data

Aug. 13, 2018 (JP) ..... JP2018-152512

(51) Int. Cl.

| | |
|---|---|
| ***B41J 11/00*** | (2006.01) |
| ***B41J 2/085*** | (2006.01) |
| *B41J 2/02* | (2006.01) |

(52) U.S. Cl.

CPC ..... *B41J 11/0015* (2013.01); *B41J 2/085* (2013.01); *B41J 2002/022* (2013.01)

(58) Field of Classification Search

CPC ... B41J 11/0015; B41J 2/085; B41J 2002/022

See application file for complete search history.

(56) References Cited

U.S. PATENT DOCUMENTS 5,838,349 A * 11/1998 Choi ..... B41J 2/04576 347/55

FOREIGN PATENT DOCUMENTS

JP 2015013455 1/2015

* cited by examiner

*Primary Examiner* — Geoffrey S Mruk

(74) *Attorney, Agent, or Firm* — JCIPRNET

(57) ABSTRACT

A printing apparatus is provided and includes: a platen that supports a medium; an inkjet head provided to face the medium, the inkjet head ejecting an ink containing a charge controlling agent toward the medium by driving a drive element to land the charged ink droplet, which becomes a polarity of one of the positive polarity and the negative polarity, on the medium; and a voltage applying part that applies to at least one of the platen and the medium to have the other polarity of the positive polarity and the negative polarity.

19 Claims, 8 Drawing Sheets

PRINTING APPARATUS

CROSS REFERENCE TO RELATED APPLICATIONS

This application claims the priority benefit of Japanese Patent Application No. 2018-152512, filed on Aug. 13, 2018. The entirety of the above-mentioned patent application is hereby incorporated by reference herein and made a part of this specification.

TECHNICAL FIELD

The present disclosure relates to a printing apparatus that ejects ink.

DESCRIPTION OF THE BACKGROUND ART

As a printing apparatus that performs printing on a medium to be printed, for example, an inkjet type printing apparatus that ejects droplets from a head to the medium is known (see, e.g., Japanese Unexamined Patent Publication No. 2015-13455 (Patent Literature 1)). Such a printing apparatus includes, for example, a mounting stand on which the medium can be mounted, and a head that ejects droplets toward the surface of the medium while reciprocating the mounting stand in a main scanning direction.

Patent Literature 1: Japanese Unexamined Patent Publication No. 2015-13455.

SUMMARY

Here, an inkjet head that uses a drive element such as a piezoelectric element may be adopted as a head. When printing a high-definition image on a medium using such an inkjet head, the size of ink droplets ejected from the inkjet head needs to be small. However, if the size of the ink droplet is small, the speed of the ink droplet ejected from the inkjet head is rapidly reduced due to the influence of air resistance, and hence the landing of the ink droplet on the medium is disarrayed. Furthermore, if a gap between the inkjet head and the medium is narrowed in order to reduce the disarray of the landing of the ink droplets, rubbing between the inkjet head and the medium is likely to occur. Thus, it has become difficult to secure a gap necessary for an inkjet printer that performs on-demand printing, and it has been difficult to achieve high definition of an image printed by the inkjet printer.

In a case in which an ink that requires drying such as an evaporation-drying ink and a UV instant-drying ink is used as the ink to be used for printing, when the ink is dried and heated, a coloring material such as a pigment and the like and a dispersion agent such as a resin and the like contained in the ink may flow around the ink droplets, which may cause density unevenness of the ink such as a coffee stain phenomenon. In this case, in order to suppress the occurrence of the coffee stain phenomenon, it is conceivable to heat the medium at a high temperature to rapidly dry the ink by the print heater provided opposite to the inkjet head, but if the temperature of the print heater is high, the ink adheres to the nozzles as the inkjet head is heated, which may cause nozzle clogging.

Furthermore, when an impermeable medium such as metal or resin that is impermeable to ink is used as the medium, air enters a gap between the ink and the impermeable medium when the ink attaches to the impermeable medium, which may lower the adhesion between the ink and the impermeable medium. Moreover, when a permeable medium such as a fabric, paper and the like having permeability to ink is used as the medium, the ink may stay on the surface of the permeable medium and the ink may not permeate to the inside of the permeable medium. In such a case, the ink is likely to peel off from the medium.

Therefore, the present disclosure provides a printing apparatus capable of appropriately printing a high definition and high quality image on a medium even when performing on-demand printing.

A printing apparatus of the present disclosure includes an ejection head provided to face a medium, the ejection head ejecting an ink containing a charge controlling agent toward the medium as a charged ink droplet to land the charged ink droplet on the medium; and a polarity applier that applies polarity to the medium so as to have an opposite polarity with respect to the polarity of the charged ink droplet.

According to this configuration, since the charged ink droplets ejected from the ejection head are attracted to the medium by the Coulomb force, which becomes the attracting force, they can fly toward the medium against air resistance. Thus, the decrease in the speed of the charged ink droplet can be suppressed, whereby the disarray of the landing of the charged ink droplet on the medium can be suppressed, and the gap necessary for on-demand printing can be secured without narrowing the gap between the ejection head and the medium. Therefore, high definition of the image to be printed can be achieved even in the on-demand printing. Furthermore, since the charged ink droplets that landed on the medium are drawn to the medium side by the Coulomb force to become the attracting force, the fixability of the charged ink droplets to the medium is improved. Therefore, at the time of heating and drying the ink and the like, the flow of the coloring material and the like contained in the ink can be suppressed, and for example, the occurrence of density unevenness such as the coffee stain phenomenon can be suppressed. Therefore, even if the ink requires drying, the image to be printed can be of high quality. The ink may have polarity in advance or may be charged at the time of ejection. Furthermore, since the charged ink droplets that landed on the medium are drawn to the medium side by the Coulomb force to become the attracting force, the adhesion between the medium and the ink can be improved. That is, when the medium is an impermeable medium capable of applying polarity, the adhesion between the medium and the ink can be improved by removing air from the gap between the medium and the ink.

Furthermore, the polarity applier preferably includes: a first charger, provided to face the medium before the charged ink droplet lands on the medium, the first charger charging the medium to the opposite polarity from the charged ink droplet.

According to the configuration, since the charged ink droplets ejected from the ejection head can be attracted to the medium having an opposite polarity from the charged ink droplets by the Coulomb force, the adhesion between the medium and the ink can be improved.

Another printing apparatus of the present disclosure includes a mounting portion on which a medium is placed; an ejection head provided to face the medium, the ejection head ejecting an ink containing a charge controlling agent toward the medium as a charged ink droplet to land the charged ink droplet on the medium; and a polarity applier that applies polarity to the mounting portion so as to be have an opposite polarity with respect to a polarity of the charged ink droplet.

According to this configuration, since the charged ink droplets ejected from the ejection head are attracted to the mounting portion by the Coulomb force, which becomes the attracting force, they can fly toward the medium placed on the mounting portion against air resistance. Thus, the decrease in the speed of the charged ink droplet can be suppressed, whereby the disarray of the landing of the charged ink droplet on the medium can be suppressed, and the gap necessary for on-demand printing can be secured without narrowing the gap between the ejection head and the medium. Therefore, high definition of the image to be printed can be achieved even in the on-demand printing. Furthermore, since the charged ink droplets that landed on the medium are drawn to the medium side by the Coulomb force to become the attracting force, the fixability of the charged ink droplets to the medium is improved. Therefore, at the time of heating and drying the ink and the like, the flow of the coloring material and the like contained in the ink can be suppressed, and for example, the occurrence of density unevenness such as the coffee stain phenomenon can be suppressed. Therefore, even if the ink requires drying, the image to be printed can be of high quality. The ink may have polarity in advance or may be charged at the time of ejection. Furthermore, since the charged ink droplets that landed on the medium are drawn to the medium side by the Coulomb force to become the attracting force, the adhesion between the medium and the ink can be improved. That is, when the medium is an impermeable medium capable of applying polarity, the adhesion between the medium and the ink can be improved by removing air from the gap between the medium and the ink. Furthermore, even if the medium is a permeable medium which is difficult to apply polarity, the ink can be permeated into the medium by drawing the ink into the medium by the Coulomb force, so that the adhesion between the medium and the ink can be improved.

The polarity applier preferably includes: a voltage applying part that applies a voltage between a conductive portion provided in the ejection head and the mounting portion to be conductive to generate an electric field between the ejection head and the mounting portion, thus increasing an abutment force between the medium and the charged ink droplet.

According to this configuration, the voltage applying part can charge the ink droplet ejected from the ejection head to one polarity at the conductive portion of the ejection head to form a charged ink droplet. Moreover, the voltage applying part charges the mounting portion to the other polarity to generate an electric field between the ejection head and the mounting portion, whereby the charged ink droplet can be drawn toward the mounting portion side by the Coulomb force.

Another printing apparatus of the present disclosure includes an ejection head provided to face a medium, the ejection head ejecting an ink containing a charge controlling agent toward the medium as a charged ink droplet to land the charged ink droplet on the medium; and a polarity applier that applies polarity to a side of the ejection head so as to have the same polarity as a polarity of the charged ink droplet.

According to this configuration, the charged ink droplet ejected from the ejection head can fly toward the medium against air resistance by repelling the side of the ejection head by the coulomb force which becomes a repulsive force. Thus, the decrease in the speed of the charged ink droplet can be suppressed, whereby the disarray of the landing of the charged ink droplet on the medium can be suppressed, and the gap necessary for on-demand printing can be secured without narrowing the gap between the ejection head and the medium. Therefore, high definition of the image to be printed can be achieved even in the on-demand printing. Furthermore, since the charged ink droplets that landed on the medium repel the side of the ejection head by the Coulomb force, which becomes the repulsive force, the charged ink droplets are pressed against the medium, whereby the fixability of the charged ink droplets to the medium is improved. Therefore, at the time of heating and drying the ink and the like, the flow of the coloring material and the like contained in the ink can be suppressed, and for example, the occurrence of density unevenness such as the coffee stain phenomenon can be suppressed. Therefore, even if the ink requires drying, the image to be printed can be of high quality. The ink may have polarity in advance or may be charged at the time of ejection. Furthermore, since the charged ink droplets that landed on the medium repel the side of the ejection head by the Coulomb force, which becomes the repulsive force, the charged ink droplets are pressed against the medium, whereby the adhesion between the medium and the ink can be improved That is, when the medium is an impermeable medium, air is removed from the gap between the medium and the ink, whereby the adhesion between the medium and the ink can be improved. Furthermore, even if the medium is a permeable medium, the ink can be permeated into the medium as the charged ink droplet are pressed against the medium by the Coulomb force, which becomes the repulsive force, and hence the adhesion between the medium and the ink can be improved.

The polarity applier preferably includes: a second charger, provided to face the medium on which the charged ink droplet landed, the second charger charging the medium to the same polarity as the charged ink droplet.

According to the configuration, the charged ink droplet that landed on the medium can be repelled by the second charger that charges the medium to the same polarity as the charged ink droplet, and the charged ink droplet can be pressed against the medium by the Coulomb force which becomes the repulsive force, and hence the adhesion between the medium and the ink can be improved.

The first and second chargers are preferably a shield type corona ion charger that generates ions by corona discharge.

According to such a configuration, the medium can be charged with a uniform potential by using the shield type corona ion charger.

The printing apparatus preferably further includes: a neutralizer that neutralizes the charged ink droplet and the medium after printing.

According to the configuration, the charged state of the printed medium can be released, and the influence of the charging in the post-processing process can be eliminated.

DESCRIPTION OF EMBODIMENTS

Embodiments of the present disclosure will be described in detail below with reference to the drawings. The present disclosure is not limited by the embodiments. Furthermore, the configuring elements in the following embodiments include those that can be replaced by a person skilled in the art and those that are easy or substantially the same. Moreover, the configuring elements described below can be appropriately combined, and when there are a plurality of embodiments, each embodiment can be combined.

First Embodiment

A printing apparatus according to the first embodiment is an apparatus for printing an image on a medium by an inkjet method. As a medium, for example, an impermeable medium that uses metal, resin, and the like which is impermeable to ink, and a permeable medium that uses fabric, paper and the like which is permeable to ink can be applied, and any material can be applied as long as it is a medium on which an image can be formed. Furthermore, the medium has a surface to be formed on which an image is formed, and the surface to be formed may be an irregular surface, a flat surface, or a curved surface in shape, and any shape can be applied as long as it is a shape that allows image to be formed. Next, the ink used in the printing apparatus will be described with reference to FIG. 1.

Figure 1:
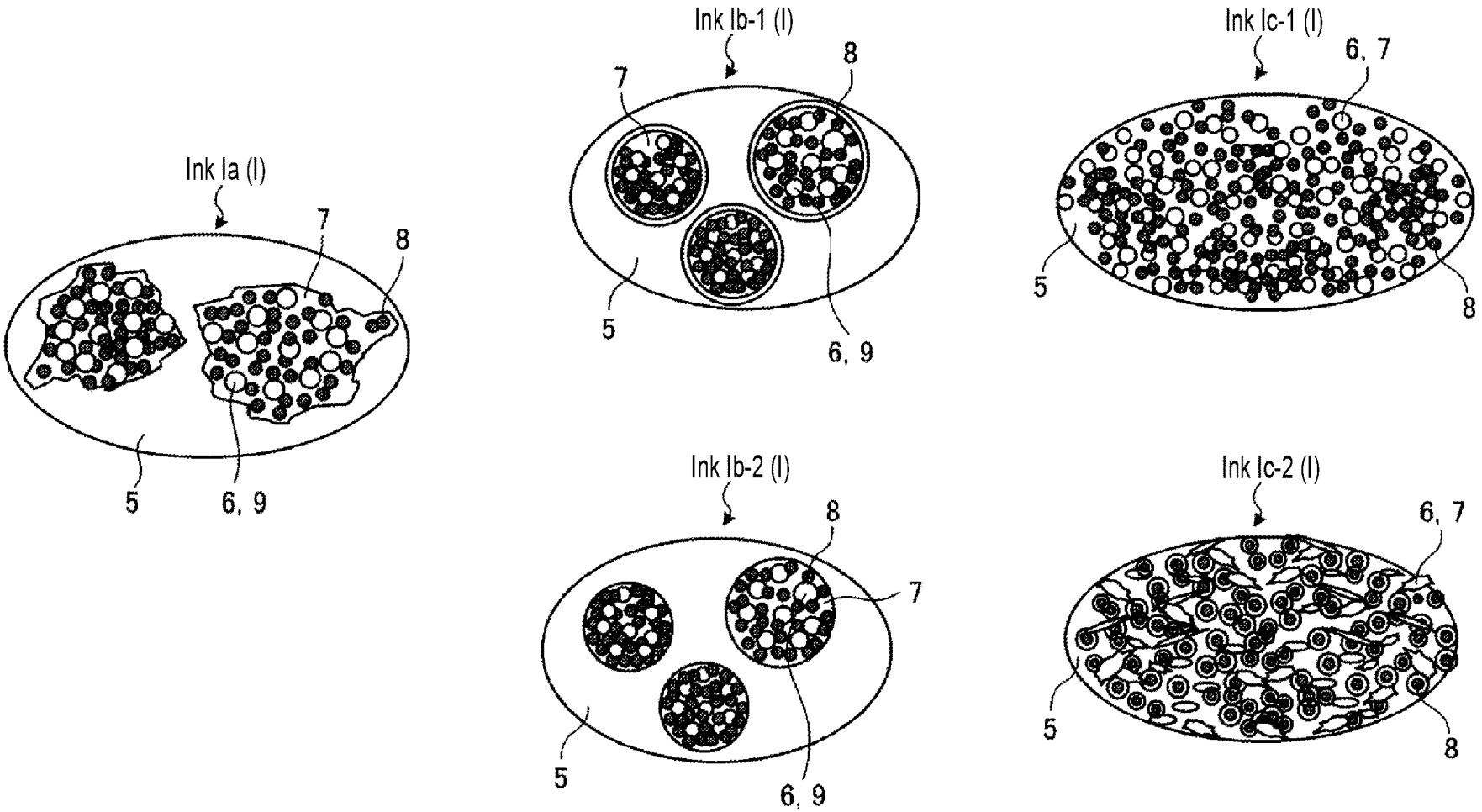
FIG. 1 is an explanatory view related to ink used in a printing apparatus according to a first embodiment.

FIG. 1 is an explanatory view related to ink used in the printing apparatus according to the first embodiment. For the ink I, for example, evaporation-drying ink such as solvent ink, aqueous ink, latex ink, or the like and UV instant-drying ink (ink containing UV absorbent) can be applied. Furthermore, as the ink, for example, an aqueous UV curable ink, a solvent diluted UV curable (SUV) ink, or a low viscosity UV curable ink can be applied.

As shown in FIG. 1, the ink I is an ink I containing a charge controlling agent. Specifically, the ink I contains at least a solvent 5, a charge controlling agent 6, a binder resin 7, and a coloring material 8 such as a pigment, and appropriately contains paraffin 9 according to the aspect of the ink. The ink comes in various forms, and as an example, includes an amorphous color resin dispersed ink Ia, spherical coloring material containing resin dispersed inks Ib-1 and Ib-2, and inks 1*c*-1, 1*c*-2 in which the coloring material and the resin are dispersed. The amorphous color resin dispersed ink Ia is a mixture in which the amorphous particles in which the charge controlling agent, the paraffin, and the coloring material are bound by the binder resin are mixed in the solvent. The spherical coloring material containing resin dispersed ink Ib-1 is a mixture in which the charge controlling agent, the paraffin, and the coloring material are bound with the binder resin, and then formed to a sphere by coating of a high polymer capsule and mixed in the solvent. The spherical coloring material containing resin-dispersed ink Ib-1 is a mixture in which spherical particles in which the charge controlling agent, the paraffin, and the coloring material are bound with the binder resin are mixed in the solvent. The ink Ic-1 is a mixture in which the spherical resin particles composed of the charge controlling agent and the binder resin and the coloring material are dispersed and mixed in the solvent. The ink Ic-2 is a mixture in which the amorphous particles composed of the charge controlling agent and the binder resin and the coloring material are dispersed and mixed in the solvent.

Figure 2:
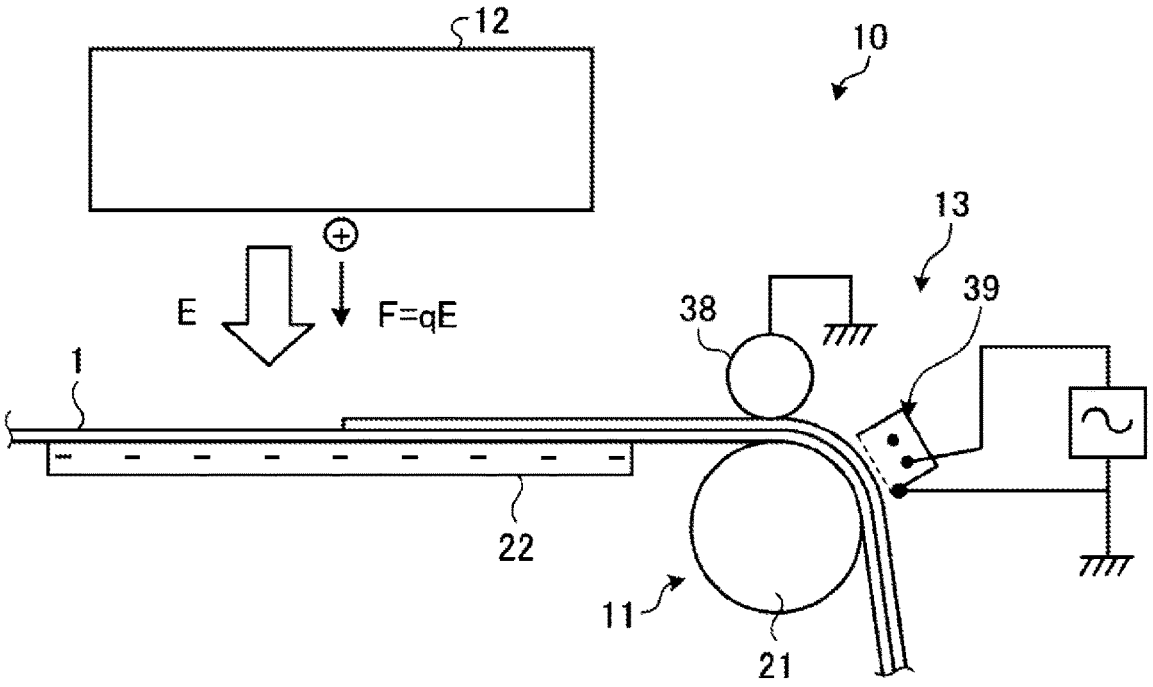
FIG. 2 is a schematic view showing the printing apparatus according to the first embodiment.
Figure 3:
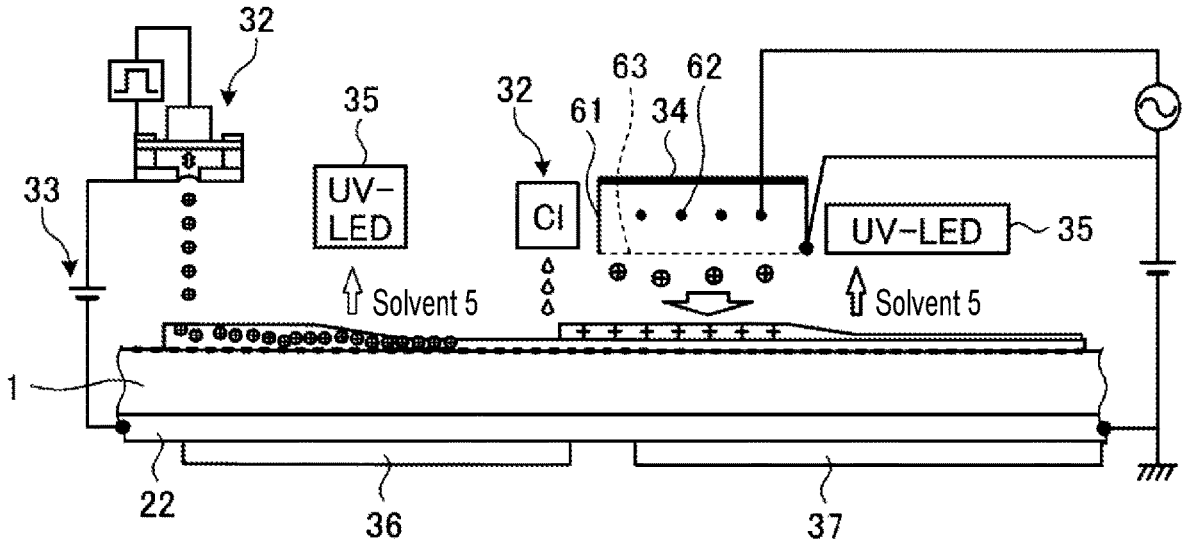
FIG. 3 is a schematic view showing the periphery of an inkjet head in the printing apparatus according to the first embodiment.
Figure 4:
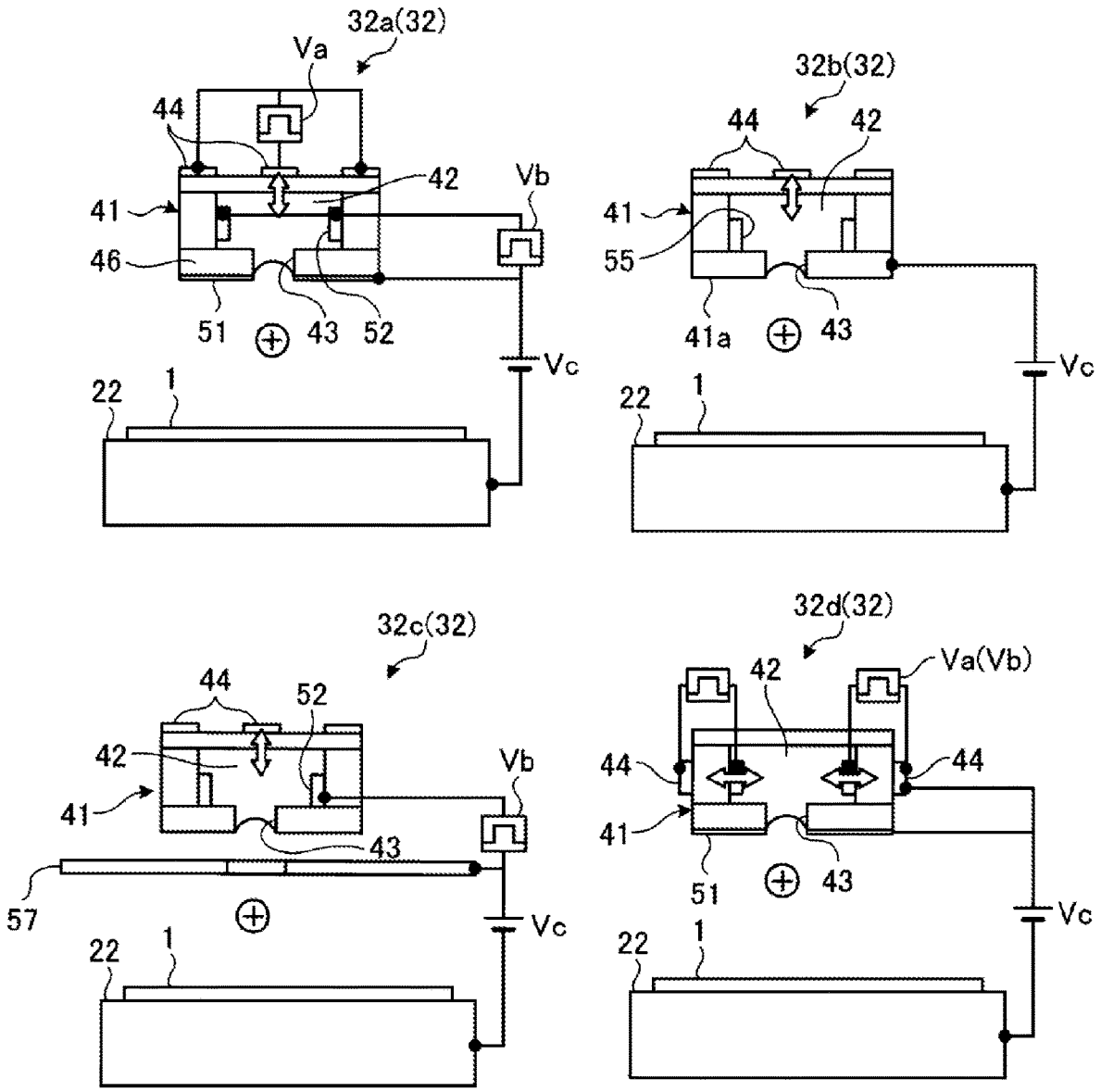
FIG. 4 is a schematic view showing one example of the inkjet head in the printing apparatus according to the first embodiment.
Figure 5:
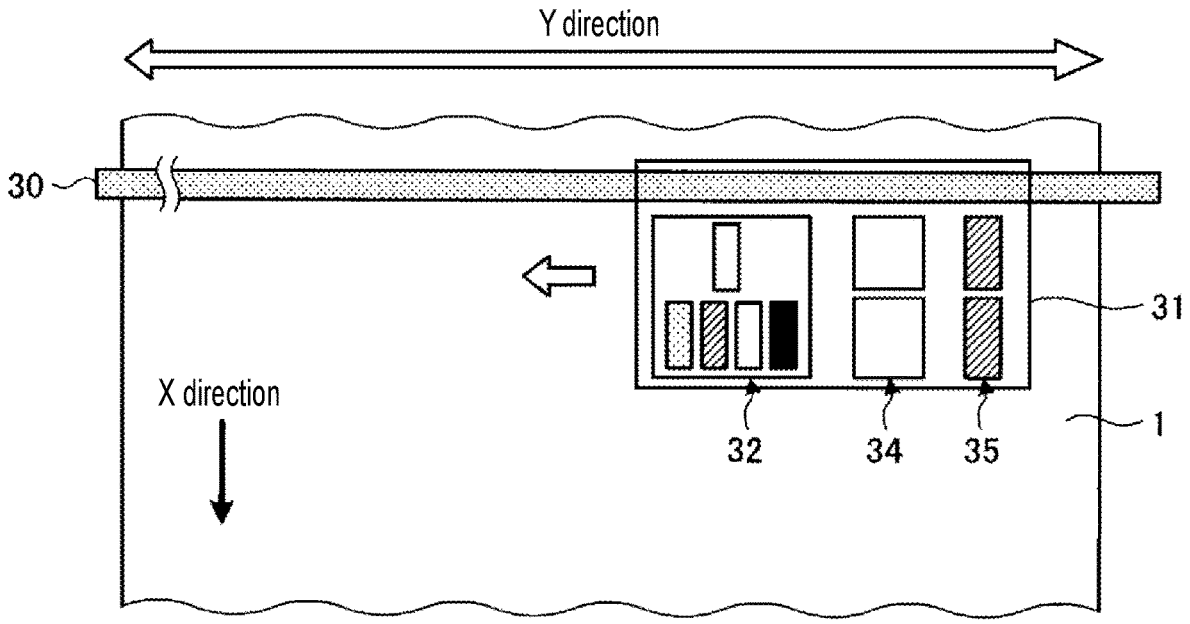
FIG. 5 is a plan view schematically showing the periphery of the inkjet head in the printing apparatus according to the first embodiment.

Next, the printing apparatus 10 will be described with reference to FIGS. 2 to 5. FIG. 2 is a schematic view showing the printing apparatus according to the first embodiment. FIG. 3 is a schematic view showing the periphery of the inkjet head in the printing apparatus according to the first embodiment. FIG. 4 is a schematic view showing one example of the inkjet head in the printing apparatus according to the first embodiment. FIG. 5 is a plan view schematically showing the periphery of the inkjet head in the printing apparatus according to the first embodiment. In the printing apparatus 10 according to the first embodiment, for example, UV instant-drying ink is used as the ink. The UV instant-drying ink contains a UV absorbent, and when irradiated with an ultraviolet light, the UV absorbent generates heat, which causes the solvent contained in the ink to dry by volatilizing.

As shown in FIGS. 2 and 3, the printing apparatus 10 conveys a medium 1 (permeable medium) in which microscopic irregularities are formed on the surface such as the fabric, paper and the like in a conveyance direction (X direction), and ejects ink from the inkjet head to the medium 1 to be conveyed to form an image on the medium 1. Although the first embodiment is described as being applied to the medium 1 in which microscopic irregularities are formed on the surface to be formed, it may be applied to the medium 1 having a smooth surface to be formed, and is not particularly limited. Furthermore, although FIG. 2 illustrates various processes to be performed on the medium 1 so as to be sequentially carried out over the conveyance direction for the sake of simplicity, the configuration shown in FIG. 2 is not the sole case as the inkjet head is moved in a scanning direction (Y direction) orthogonal to the conveyance direction, and the various processes are performed even over the scanning direction.

As shown in FIG. 2, the printing apparatus 10 includes a conveyance section 11, a printing part 12, and a neutralizer 13. The printing apparatus 10 performs printing on the medium 1 by the printing part 12 while conveying the medium 1 by the conveyance section 11 and performs neutralization by the neutralizer 13 on the printed medium 1.

The conveyance section 11 includes a conveyor roller 21 and a platen 22. The conveyor roller 21 is provided on the downstream side of the platen 22 in the conveyance direction, and serves as a driving roller that pulls the medium 1 on the platen 22 in the conveyance direction. The platen 22 is provided to face the printing part 12 and functions as a mounting portion on which the medium 1 is mounted, where a surface that comes into contact with the medium 1 is a flat surface. Therefore, the medium 1 is subjected to the process by the printing part 12 on the platen 22. The platen 22 is formed of a conductive material such as metal and is connected to a voltage applying part 33 to be described later.

The printing part 12 is provided on the opposite side of the platen 22 so as to face the platen 22 with the medium 1 in between. The printing part 12 includes a carriage 30, a base 31, an inkjet head 32, a voltage applying part (polarity applier) 33, a charger (second charger) 34, an ultraviolet irradiation part 35, a platen heater 36, and an after-heater 37. Assuming that the conveyance direction of the medium 1 is the X direction, the printing part 12 scans the inkjet head 32 in the flat surface of the platen 22 with the Y direction orthogonal to the X direction as the scanning direction.

As shown in FIG. 5, the carriage 30 is provided to extend in the Y direction, and guides the inkjet head 32 to move in the Y direction. The base 31 is provided on the carriage 30 and is movable in the Y direction by a drive source (not shown). The inkjet head 32 is provided on the base 31 and ejects the ink shown in FIG. 1 toward the medium 1 to land charged ink droplets having the polarity of one of the positive polarity and the negative polarity (positive polarity in the first embodiment) on the medium 1. A plurality of inkjet heads 32 are provided according to the type of color to use, and for example, the inkjet heads 32 for four colors of C, M, Y, and K are arranged side by side in the Y direction. Furthermore, as the inkjet head 32, the inkjet head 32 for a clear color is provided, which inkjet head 32 for the clear color is arranged side by side in the X direction with respect to the inkjet head 32 for four colors of C, M, Y, and K.

The charger 34 is provided on the base 31 and is charged to the same polarity (positive polarity) as the charged ink droplets ejected onto the medium 1. The charger 34 is, for example, a shield type corona ion charger, and discharges ion charges of both polarities from the discharging electrode by corona discharge and collects the ion charges of opposite polarity (negative polarity) from the charged ink droplets from the shield type ground electrode to discharge the ion charges of the same polarity (positive polarity) as the charged ink droplets toward the medium 1.

Specifically, the charger 34 is configured to include a shield case 61, a discharging electrode 62, and a mesh electrode 63. The discharging electrode 62 is, for example, a string-like wire, and is disposed in an inner space partitioned by the shield case 61 and the mesh electrode 63. When a voltage is applied to the discharging electrode 62, ions are generated from the discharging electrode 62 by corona discharge. In the first embodiment, since the voltage applied to the discharging electrode 62 is an alternating current (AC) voltage, positive and negative ions are discharged from the discharging electrode 62. The mesh electrode 63 is provided to face the medium 1 on the platen 22. A voltage is applied between the mesh electrode 63 and the platen. The voltage applied between the mesh electrode 63 and the platen is a direct current (DC) voltage, and as the mesh electrode 63 is connected to the positive side, positive ion charges are discharged from the charger 34 toward the medium 1. At this time, the voltage applied to the mesh electrode 63 regulates the charging voltage of the medium 1.

As shown in FIG. 5, in the charger 34, the chargers 34 for C, M, Y, K and the charger 34 for clear are provided side by side in the X direction. The charger 34 is provided adjacent to the inkjet head 32 in the Y direction.

The ultraviolet irradiation part 35 is provided on the base 31 and irradiates ultraviolet light toward the charged ink droplets ejected on the medium 1. The charged ink droplets are dried by the generation of heat by the UV absorbent contained in the ink when irradiated with ultraviolet light. The ultraviolet irradiation part 35 has an ultraviolet irradiation part 35 for C, M, Y, K and an ultraviolet irradiation part 35 for clear arranged side by side in the X direction. Furthermore, the ultraviolet irradiation part 35 is provided adjacent to the charger 34 in the Y direction, and is provided on the opposite side of the inkjet head 32 with the charger 34 in between.

Here, the printing part 12 performs printing when the base 31 moves in one direction from one side to the other side in the Y direction, the inkjet head 32 is provided on the preceding side in the Y direction, the ultraviolet irradiation part 35 is provided on the trailing side in the Y direction, and the charger 34 is provided between the inkjet head 32 and the ultraviolet irradiation part 35.

As shown in FIG. 3, the voltage applying part 33 applies voltage between the inkjet head 32 and the platen 22 to generate an electric field. The voltage applying part 33 has one end connected to the conductive portion of the inkjet head 32, and the other end connected to the platen 22 made of a conductive material. The voltage applying part 33 generates an electric field so that the inkjet head 32 becomes a positive polarity and the platen 22 becomes a negative polarity. The voltage applying part 33 charges the inkjet head 32 to a positive polarity, so that the ink ejected from the inkjet head 32 becomes the charged ink droplets of the positive polarity. In this case, at least a part of the charged ink droplet on the medium 1 side merely needs to be a positive polarity. That is, the charged ink droplets may be entirely positive polarity, or one part on the medium 1 side may be a positive polarity and one part on the head side may be a negative polarity.

The platen heater 36 heats the platen 22 and heats the medium 1 conveyed on the platen 22 by heating the platen 22. The after-heater 37 is provided on the downstream side of the platen heater 36 in the conveyance direction of the medium 1 and post-heats the medium 1 heated by the platen heater 36.

The neutralizer 13 extracts corona ions having a reversed polarity from the charging voltage of the medium 1 to neutralize the medium 1 to charge after printing. The neutralizer 13 includes a neutralizing roller 38 provided to face the conveyor roller 21 and a neutralizer 39 provided on the downstream side of the neutralizing roller 38. The neutralizing roller 38 is in rolling contact with the printed medium 1 and is earth connected. The neutralizer 39 interiorly includes a corona discharging electrode, and has substantially the same configuration as the charger 34. The neutralizer 39 is, for example, a shield type corona ion neutralizer, and discharges ion charge of both polarities from the discharging electrode by corona discharge, and collects ion charges unnecessary for neutralization of the medium 1 from the shield type ground electrode so that the ion charge of an opposite polarity (negative polarity) from the medium 1 is discharged toward the medium 1 thus neutralizing the medium 1.

Next, the inkjet head 32 will be described with reference to FIG. 4. A part of the inkjet head 32 is charged to the positive polarity by the voltage applying part 33 so that the ejected ink is a charged ink droplet of the positive polarity. In FIG. 4, for example, four inkjet heads 32*a*, 32*b*, 32*c*, and 32*d* are illustrated as aspects of the inkjet head 32. First, the configuration of the inkjet head 32 will be described.

The inkjet head 32 includes a head body 41, a pressure chamber 42, a nozzle 43, and a plurality of drive elements 44.

The head body 41 is formed to a box shape to become a rectangular solid. The shape of the head body 41 is not limited thereto. The head body 41 has a surface facing the platen 22 and the medium 1 as an ejection surface 46 on which the nozzle 43 is provided, and the ejection surface 46 is a flat surface.

The pressure chamber 42 is a space formed inside the head body 41, and is filled with ink. The nozzle 43 is a hole for ejecting ink, and is formed to pass through the ejection surface 46 of the head body 41. The pressure chamber 42 and the nozzle 43 are communicated with each other. Therefore, the nozzle 43 ejects a part of the ink filled in the pressure chamber 42.

The plurality of drive elements 44 form a part of the pressure chamber 42. The drive element 44 is, for example, a piezoelectric element such as a piezoelectric element, and is deformed by the application of the driving voltage Va thus varying the pressure of the ink in the pressure chamber 42. The drive element 44 causes the pressure of the ink inside the pressure chamber 42 to rise and fall by deforming, and causes the charged ink droplet to be ejected from the nozzle 43. The drive element 44 is not limited to the one shown in FIG. 4, and can be applied to all driving methods classified into the conventional piezo method. For example, the drive element 44 may be layered and formed on a diaphragm film forming the pressure chamber 42. Furthermore, it may be of a thermal method referred to as a THERMAL JET or BUBBLE JET (registered trademark).

Such an inkjet head 32 ejects charged ink droplets from the nozzle 43 by varying the pressure inside the pressure chamber by applying a driving voltage to the drive element.

Here, in the inkjet head 32*a* of FIG. 4, the nozzle surface plate 51 is provided on the ejection surface 46 on which the nozzles 43 are provided. The nozzle surface plate 51 is a planar shaped member formed using a conductive material, where a through hole is formed at a position corresponding to the nozzle 43 and it is joined to the ejection surface 46. Furthermore, a charging member 52 is provided inside the pressure chamber 42 in the inkjet head 32*a*. The charging member 52 is a member formed using a conductive material, and is joined to the inner wall of the head body 41.

Then, in the inkjet head 32*a*, a pulse charging voltage Vb is applied between the nozzle surface plate 51 and the charging member 52. Furthermore, in the inkjet head 32*a*, an acceleration voltage Vc is applied between the nozzle surface plate 51 and the charging member 52, and the platen 22. Therefore, the inkjet head 32*a* charges the ink to the positive polarity and ejects the charged ink droplet charged to the positive polarity at the time of ejecting ink. Moreover, the charged ink droplets charged to the positive polarity are attracted to the platen 22, which becomes a negative polarity by the Coulomb force, and fly.

In the inkjet head 32*b* of FIG. 4, the portion configuring the ejection surface 46 of the head body 41 is a conductive portion 41*a*. Furthermore, in the inkjet head 32*b*, a charging member 55 is provided inside the pressure chamber 42. The charging member 55 is a member formed using a conductive material, and is joined to the inner wall of the head body 41 and is also joined to the conductive portion 41*a* of the head body 41.

In the inkjet head 32*b*, an acceleration voltage Vc is applied between the conductive portion 41*a* of the head body 41 and the platen 22. Therefore, the inkjet head 32*b* charges the ink to the positive polarity and ejects the charged ink droplet charged to the positive polarity at the time of ejecting ink. Moreover, the charged ink droplets charged to the positive polarity are attracted to the platen 22, which becomes a negative polarity by the Coulomb force, and fly.

In addition to the configuration of the inkjet head 32*b*, the inkjet head 32*c* of FIG. 4 includes a conductive plate 57 at a position facing the ejection surface 46 of the head body 41. The conductive plate 57 is provided with a gap with respect to the ejection surface 46, and has a through hole formed at a position corresponding to the nozzle 43.

Then, in the inkjet head 32*c*, a pulse charging voltage Vb is applied between the conductive plate 57 and the conductive portion 41*a*. Furthermore, in the inkjet head 32*a*, an acceleration voltage Vc is applied between the conductive plate 57 and the conductive portion 41*a*, and the platen 22. Therefore, the inkjet head 32*a* charges the ink to the positive polarity and ejects the charged ink droplet charged to the positive polarity at the time of ejecting ink. Moreover, the charged ink droplets charged to the positive polarity are attracted to the platen 22, which becomes a negative polarity by the Coulomb force, and fly.

The inkjet head 32*d* of FIG. 4 has a configuration in which the drive element 44 of the inkjet head 32*a* is caused to function as a charging member for charging the ink, and the charging member 52 is omitted.

Then, in the inkjet head 32*d*, the driving voltage Va is applied to the drive element 44, whereby the driving voltage Va functions as a pulse charging voltage Vb. That is, the driving voltage Va applied to the drive element 44 also serves as the pulse charging voltage Vb. Furthermore, in the inkjet head 32*d*, an acceleration voltage Vc is applied between the nozzle surface plate 51 and the drive element 44, and the platen 22. Therefore, the inkjet head 32*d* charges the ink to the positive polarity and ejects the charged ink droplet charged to the positive polarity at the time of ejecting ink. Moreover, the charged ink droplets charged to the positive polarity are attracted to the platen 22, which becomes a negative polarity by the Coulomb force, and fly.

Referring again to FIG. 3, the process relating to the printing of the medium 1 by the printing apparatus 10 will be described. When the medium 1 conveyed in the conveyance direction by the conveyance section 11 is moved to a position facing the inkjet head 32 of the printing part 12, the printing apparatus 10 scans the inkjet head 32 in the Y direction using the UV instant-drying ink, and ejects the charged ink droplets of the C, M, Y, K colors to the medium 1 to draw an image on the medium 1. At this time, the printing apparatus 10 charges the ink to a positive polarity by the voltage applying part 33 and generates an electric field between the inkjet head 32 and the platen 22 by the voltage applying part 33, so that the charged ink droplets are attracted toward the platen 22 by the Coulomb force. Furthermore, the printing apparatus 10 heats the charged ink droplets by irradiating the charged ink droplet landed on the medium 1 with the ultraviolet light by the ultraviolet irradiation part 35 following the inkjet head 32. The printing apparatus 10 also heats the charged ink droplets by the platen heater 36. Thus, as the charged ink droplets of the C, M, Y, K colors that landed on the medium 1 are heated, the solvent is volatilized and dried.

Subsequently, the printing apparatus 10 scans the inkjet head 32 in the Y direction, and ejects the charged ink droplets of a clear color to the medium 1 to form a clear layer on the medium 1. At this time as well, the printing apparatus 10 charges the ink to a positive polarity by the voltage applying part 33 and generates an electric field between the inkjet head 32 and the platen 22 by the voltage applying part 33, so that the charged ink droplets are attracted toward the platen 22 by the Coulomb force. Furthermore, in the printing apparatus 10, the charger 34 following the inkjet head 32 faces the charged ink droplet landed on the medium 1 thus pushing the charged ink droplet toward the platen 22 by the Coulomb force. Furthermore, the printing apparatus 10 heats the charged ink droplet by irradiating the charged ink droplet landed on the medium 1 with the ultraviolet light by the ultraviolet irradiation part 35 following the charger 34. The printing apparatus 10 also heats the charged ink droplets by the after-heater 37. Thus, as the charged ink droplet of clear color that landed on the medium 1 are heated, the solvent is volatilized and dried.

As described above, according to the first embodiment, since the charged ink droplets ejected from the inkjet head 32 by the drive element 44 are attracted to the medium 1 by the Coulomb force, they can fly toward the medium 1 against air resistance. Thus, the decrease in the speed of the charged ink droplet can be suppressed, whereby the disarray of the landing of the charged ink droplet on the medium 1 can be suppressed, and the gap necessary for on-demand printing can be secured without narrowing the gap between the inkjet head 32 and the medium 1. Therefore, high definition of the image to be printed can be achieved even in the on-demand printing. Furthermore, since the charged ink droplets that landed on the medium 1 are drawn toward the medium 1 side by the Coulomb force, fixability of the charged ink droplet to the medium 1 is improved. Therefore, at the time of heating and drying the ink and the like, the flow of the coloring material and the like contained in the ink can be suppressed, and for example, the occurrence of density unevenness such as the coffee stain phenomenon can be suppressed. Therefore, even if the ink requires drying, the image to be printed can be of high quality.

Furthermore, according to the first embodiment, the voltage applying part 33 can charge the ink droplet ejected from the inkjet head 32 to one polarity on the inkjet head 32 side to obtain a charged ink droplet. Moreover, the voltage applying part 33 charges the platen 22 to the other polarity to generate an electric field between the inkjet head 32 and the platen 22, whereby the charged ink droplet can be drawn toward the platen 22 side by the Coulomb force.

Furthermore, according to the first embodiment, as the charged ink droplet of clear color that landed on the medium 1 repels against the charger 34, the charged ink droplet is pressed against the medium 1 and hence fixability of the charged ink droplet to the medium 1 can be further improved.

In the first embodiment, the inkjet head 32 side (charged ink droplet) is the positive polarity and the platen 22 is the negative polarity, but the positive polarity and the negative polarity may be reversed.

In the first embodiment, although the platen 22 is charged to the negative polarity, the medium 1 may be charged to the negative polarity when the medium 1 is a conductive member.

Furthermore, in the first embodiment, the charged ink droplets are attracted to the medium 1 by applying a voltage between the inkjet head 32 and the platen 22 by the voltage applying part 33, but instead of the voltage applying part 33, a charger may be applied that charges the platen 22 to the opposite polarity from the charged ink droplet, that is, charges the platen 22 to the negative polarity.

Second Embodiment

Figure 6:
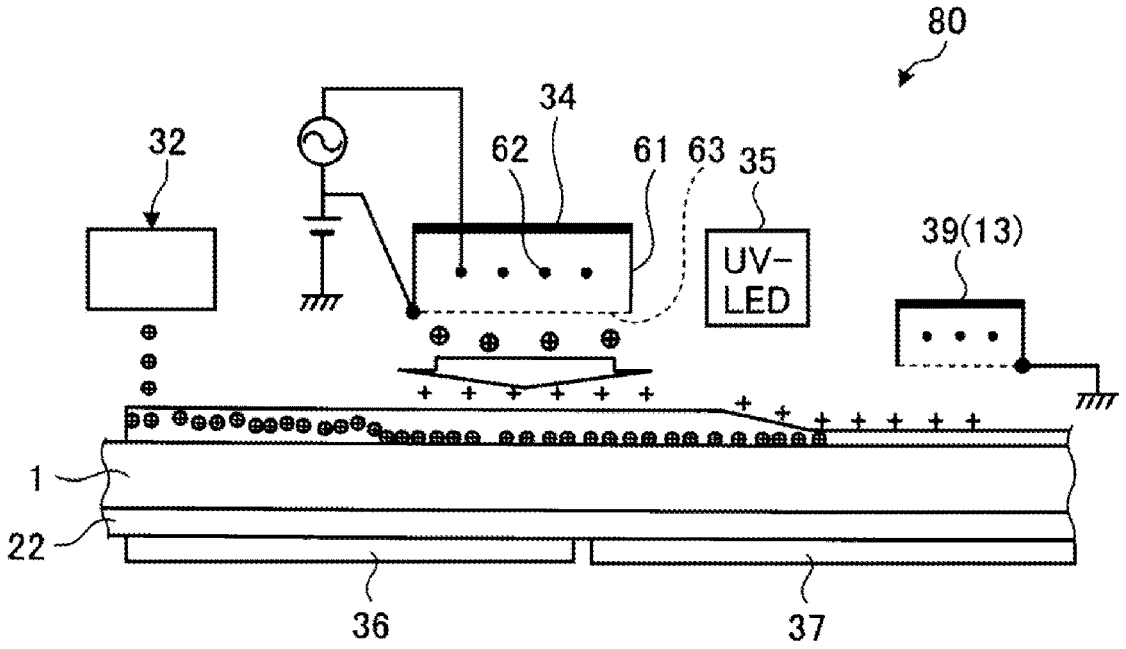
FIG. 6 is a schematic view showing a printing apparatus according to a second embodiment.

Next, a printing apparatus 80 according to a second embodiment will be described with reference to FIG. 6. In the second embodiment, in order to avoid redundant description, portions different from the first embodiment will be described, and portions having the same configuration as the first embodiment will be described with the same reference numerals. FIG. 6 is a schematic view showing the printing apparatus according to the second embodiment.

In the printing apparatus 80 according to the second embodiment, the charger (polarity applier) 34 following the inkjet head 32 faces the charged ink droplets landed on the medium 1 after the ejection of the charged ink droplets of the C, M, Y, K colors to push the charged ink droplets to the platen 22 by the Coulomb force.

Specifically, in the printing apparatus 80 according to the second embodiment, charged ink droplets are ejected from the inkjet head 32 to the medium 1, which surface to be formed is a flat surface, to form an image on the medium 1. The configuration of the printing apparatus 80 of the second embodiment is the same as that of the first embodiment in that the printing process described below can be executed, and thus the description will be omitted.

A process related to printing of the medium 1 by the printing apparatus 80 will be described with reference to FIG. 6. When the medium 1 conveyed in the conveyance direction by the conveyance section 11 is moved to a position facing the inkjet head 32 of the printing part 12, the printing apparatus 80 scans the inkjet head 32 in the Y direction using the UV instant-drying ink, and ejects the charged ink droplets of the C, M, Y, K colors to the medium 1 to draw an image on the medium 1. At this time, the printing apparatus 80 charges the ink to a positive polarity by the voltage applying part 33 and generates an electric field between the inkjet head 32 and the platen 22 by the voltage applying part 33, so that the charged ink droplets are attracted toward the platen 22 by the Coulomb force. Thereafter, in the printing apparatus 80, the charger 34 following the inkjet head 32 faces the charged ink droplets landed on the medium 1 thus pushing the charged ink droplets toward the medium 1 side (platen 22 side) by the Coulomb force. Then, the printing apparatus 80 heats the charged ink droplets by irradiating the charged ink droplets landed on the medium 1 with ultraviolet light by the ultraviolet irradiation part 35 following the charger 34. The printing apparatus 80 also heats the charged ink droplet by the platen heater 36. Thus, as the charged ink droplets of the C, M, Y, K colors that landed on the medium 1 are heated, the solvent is volatilized and dried. Then, the printing apparatus 80 performs neutralization using the neutralizer 39 on the printed medium 1.

In the second embodiment, the formation of the clear layer on the medium 1 is omitted, but it may be performed in the same manner as the first embodiment, and is not particularly limited.

Furthermore, in the printing apparatus 80 according to the second embodiment, the neutralizer 13 according to the first embodiment is configured with only the neutralizer 39 without the neutralizing roller 38.

As described above, according to the second embodiment, as the charged ink droplets of C, M, Y, 11 colors that landed on the medium 1 repel against the charger 34, the charged ink droplets are pressed against the medium 1 and hence fixability of the charged ink droplets to the medium 1 can be further improved.

In the second embodiment, the charged ink droplets are pressed against the medium 1 by repelling the charged ink droplets against the charger 34, but in place of the voltage applying part 33, a voltage applying part that applies a voltage on the ejected charged ink droplets so that the inkjet head 32 has the same polarity may be applied. In this case, the charger 34 may be omitted if the charged ink droplet can be sufficiently pressed against the medium 1 by causing the charged ink droplet to repel against the inkjet head 32 by the voltage applying part.

Third Embodiment

Figure 7:
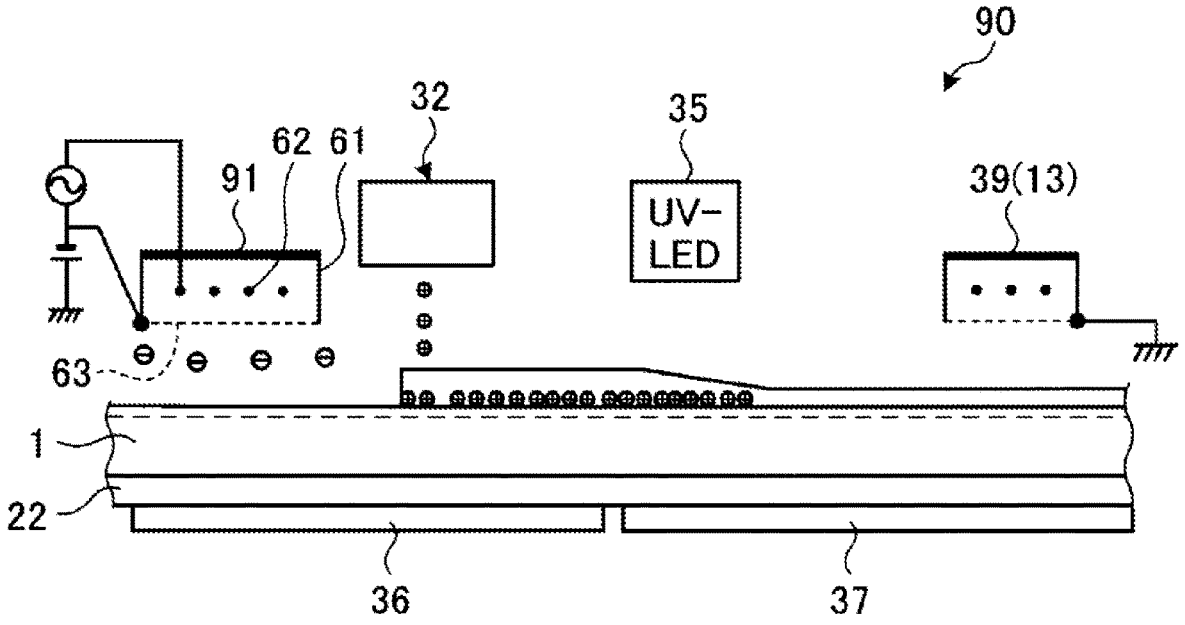
FIG. 7 is a schematic view showing a printing apparatus according to a third embodiment.

Next, a printing apparatus 90 according to a third embodiment will be described with reference to FIG. 7. In the third embodiment, in order to avoid redundant description, portions different from the first and second embodiments will be described, and portions having the same configuration as the first and second embodiments will be described with the same reference numerals. FIG. 7 is a schematic view showing the printing apparatus according to the third embodiment.

The printing apparatus 90 according to the third embodiment further includes a charger (first charger) 91 that charges the medium 1 to an opposite polarity from the charged ink droplet before the printing of the medium 1 by the inkjet head 32. In the third embodiment, an impermeable medium to be an insulating body is applied as the medium 1.

Specifically, in the printing apparatus 90 according to the third embodiment, after the surface of the medium 1 is charged to the negative polarity with respect to the medium 1 of the insulating body, which surface to be formed is a flat surface, the charged ink droplet having a positive polarity is ejected from the inkjet head 32 so that the charged ink droplet is attracted to the medium 1 by the Coulomb force.

The printing apparatus 90 of the third embodiment is the printing apparatus 10 of the first embodiment further including the charger (first charger) 91. The charger 91 is provided on the upstream side of the inkjet head 32 in the conveyance direction of the medium 1. That is, the charger 91 is a separate body from the inkjet head 32. Furthermore, the charger 91 has substantially the same configuration as the charger 34 of the first embodiment in which the polarity is opposite. That is, the charger 91 is, for example, a shield type corona ion charger, and discharges ion charges of both polarities from the discharging electrode by corona discharge and collects the ion charges of same polarity (positive polarity) as the charged ink droplets from the shield type ground electrode to discharge the ion charge having an opposite polarity (negative polarity) from the charged ink droplets toward the medium 1.

A process related to printing of the medium 1 by the printing apparatus 90 will be described with reference to FIG. 7. When the medium 1 conveyed in the conveyance direction by the conveyance section 11 is moved to a position facing the charger 91, the printing apparatus 90 charges the surface of the medium 1 to the negative polarity by the charger 91. Thereafter, the printing apparatus 90 moves the medium 1 to a position facing the inkjet head 32 of the printing part 12. The printing apparatus 90 scans the inkjet head 32 in the Y direction using the UV instant-drying ink, and ejects charged ink droplets of C, M, Y, K colors to the medium 1 to draw an image on the medium 1. At this time, the printing apparatus 90 charges the medium 1 to a negative polarity and charges the ink to a positive polarity by the voltage applying part 33 and generates an electric field between the inkjet head 32 and the platen 22 by the voltage applying part 33, so that the charged ink droplets are attracted toward the platen 22 by the Coulomb force. Thereafter, the printing apparatus 90 heats the charged ink droplets by irradiating the charged ink droplet landed on the medium 1 with the ultraviolet light by the ultraviolet irradiation part 35 following the inkjet head 32. The printing apparatus 90 also heats the charged ink droplets by the platen heater 36. Thus, as the charged ink droplets of the C, M, Y, K colors that landed on the medium 1 are heated, the solvent is volatilized and dried. Then, the printing apparatus 90 performs neutralization by the neutralizer 39 on the printed medium 1.

In the third embodiment as well, the formation of the clear layer on the medium 1 is omitted, but it may be performed in the same manner as the first embodiment, and is not particularly limited. In the third embodiment, as in the second embodiment, the charger 34 is brought to face the charged ink droplet after the charged ink droplet is landed, so that the charged ink droplet is pushed toward the medium 1 side (platen 22 side) by the Coulomb force.

As described above, according to the third embodiment, the charged ink droplets to be the positive polarity can be attracted to the medium 1 by charging the medium 1 to the negative polarity by the charger 91, so that the fixability of the charged ink droplets to the medium 1 can be further improved.

In the third embodiment, the medium 1 is charged to an opposite polarity with respect to the charged ink droplet, that is, the medium 1 is charged to a negative polarity by the charger 91, but instead of the charger 91, a voltage applying part may be applied that applies a voltage between the medium 1 and the platen 22 to attract the charged ink droplets toward the medium 1.

Fourth Embodiment

Figure 8:
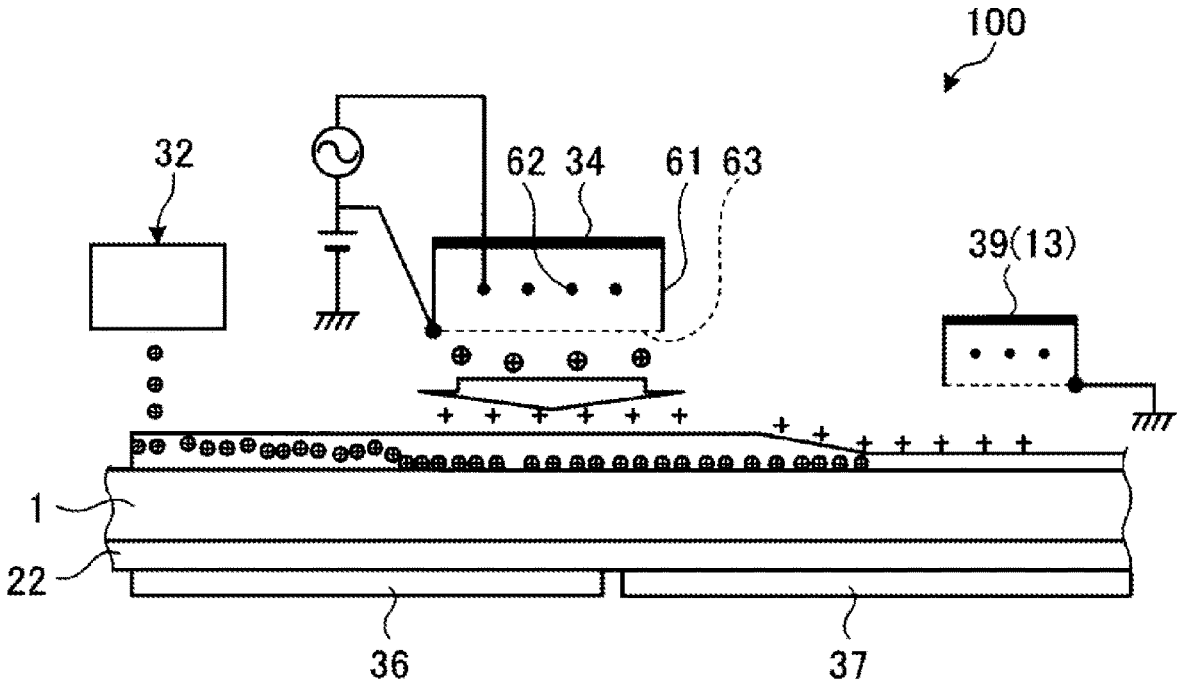
FIG. 8 is a schematic view showing a printing apparatus according to a fourth embodiment.
Figure 9:
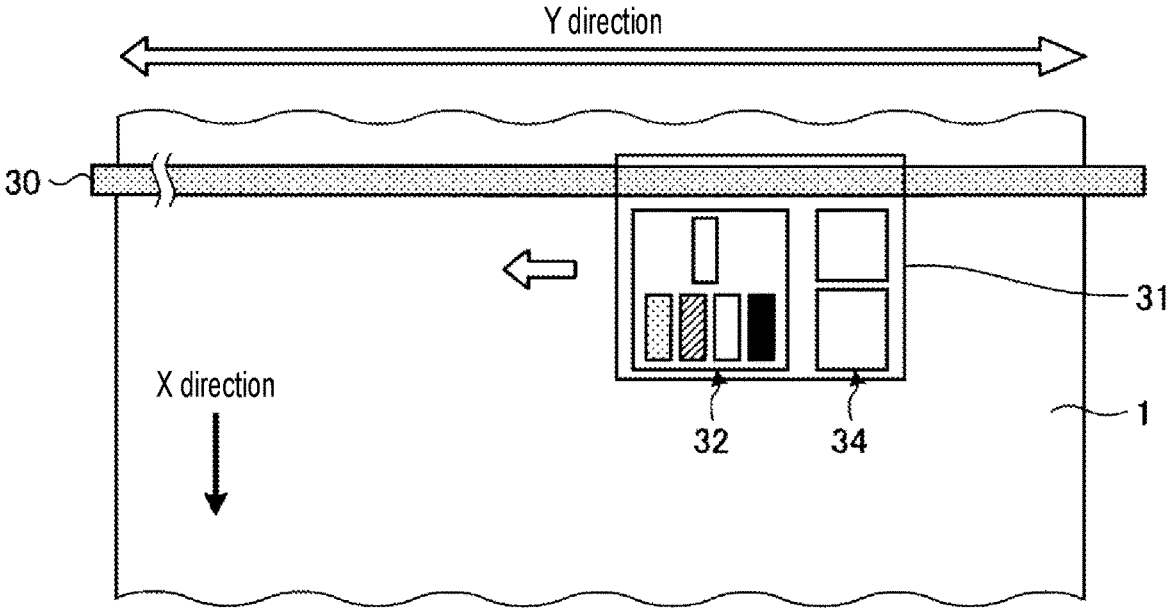
FIG. 9 is a plan view schematically showing the periphery of an inkjet head in the printing apparatus according to the fourth embodiment.

Next, a printing apparatus 100 according to a fourth embodiment will be described with reference to FIGS. 8 and 9. In the fourth embodiment as well, in order to avoid redundant description, portions different from the first to third embodiments will be described, and portions having the same configuration as the first to third embodiments will be described with the same reference numerals. FIG. 8 is a schematic view showing the printing apparatus according to the fourth embodiment. FIG. 9 is a plan view schematically showing the periphery of an inkjet head in the printing apparatus according to the fourth embodiment.

The printing apparatus 100 according to the fourth embodiment is configured to use an SUV ink as the ink instead of the UV instant-drying ink. In the printing apparatus 100 according to the fourth embodiment, the charger 34 following the inkjet head 32 faces the charged ink droplets landed on the medium 1 after the ejection of the charged ink droplets of the C, M, Y, K colors to push the charged ink droplets to the platen 22 by the Coulomb force. Here, in the printing apparatus 100 according to the fourth embodiment, since the charged ink droplets are heated and dried by the platen heater 36 and the after-heater 37, the ultraviolet irradiation part 35 of the printing part 12 is omitted.

Specifically, as shown in FIG. 9, in the printing apparatus 100 according to the fourth embodiment, the base 31 provided on the carriage 30 is provided with the inkjet head 32 and the charger 34, but is not provided with the ultraviolet irradiation part 35.

A process related to printing of the medium 1 by the printing apparatus 100 will be described with reference to FIG. 8. When the medium 1 conveyed in the conveyance direction by the conveyance section 11 is moved to a position facing the inkjet head 32 of the printing part 12, the printing apparatus 100 scans the inkjet head 32 in the Y direction using the SUV ink, and ejects the charged ink droplets of the C, M, Y, K colors to the medium 1 to draw an image on the medium 1. At this time, the printing apparatus 100 charges the ink to a positive polarity by the voltage applying part 33 and generates an electric field between the inkjet head 32 and the platen 22 by the voltage applying part 33, so that the charged ink droplets are attracted toward the platen 22 by the Coulomb force. Thereafter, in the printing apparatus 100, the charger 34 following the inkjet head 32 faces the charged ink droplets landed on the medium 1 thus pushing the charged ink droplets toward the medium 1 side (platen 22 side) by the Coulomb force. Then, the printing apparatus 100 heats the charged ink droplet by the platen heater 36 and the after-heater 37. Thus, as the charged ink droplets of the C, M, Y, K colors that landed on the medium 1 are heated, the solvent is volatilized and dried. Then, the printing apparatus 100 performs neutralization by the neutralizer 39 on the printed medium 1.

As described above, according to the fourth embodiment, as the charged ink droplets of C, M, Y, K colors that landed on the medium 1 repel against the charger 34 and the charged ink droplets are pressed against the medium 1 even in a case in which the SUV ink is used, the fixability of the charged ink droplets to the medium 1 can be further improved.

In the second to fourth embodiments, the charged ink droplets ejected from the inkjet head 32 are charged to one polarity on the inkjet head 32 side, and the platen 22 is charged to the other polarity by providing the voltage applying part 33. However, the printing apparatuses 80, 90, and 100 may omit the configuration of the voltage applying part 33 when merely enhancing the fixability of the charged ink to the medium 1. In this case, the ink may be ink charged to the positive polarity or negative polarity in advance, or may be charged to the positive polarity or negative polarity at the time of ejection.

Fifth Embodiment

Figure 10:
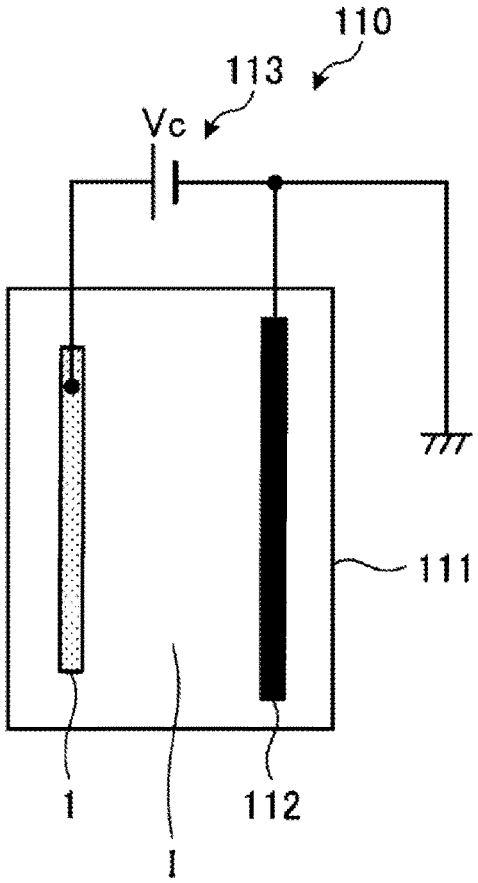
FIG. 10 is a schematic view showing a printing apparatus according to a fifth embodiment.
Figure 11:
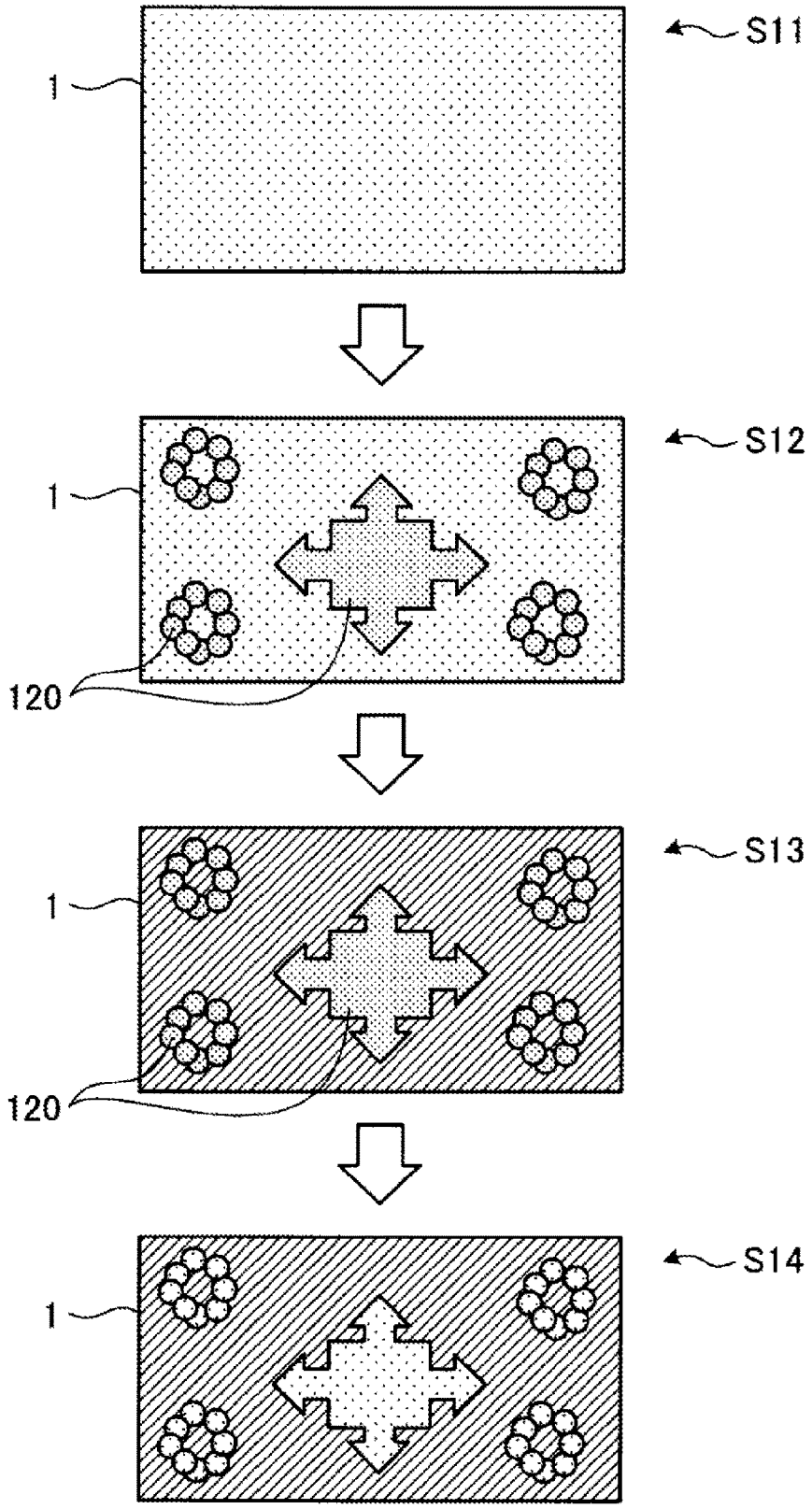
FIG. 11 is an explanatory view related to a print method using electrodeposition coating according to the fifth embodiment.

Next, a printing apparatus 110 according to a fifth embodiment will be described with reference to FIGS. 10 and 11. FIG. 10 is a schematic view showing a printing apparatus according to the fifth embodiment. FIG. 11 is an explanatory view related to a print method using electrodeposition coating according to the fifth embodiment.

The printing apparatus 110 according to the fifth embodiment immerses the medium 1 in the ink I to electrodeposit the medium 1. As shown in FIG. 10, the printing apparatus 110 is configured to include an ink tank 111, an electrode 112 provided inside the ink tank 111, and a voltage applying part 113 that applies a voltage between the medium 1 and the electrode 112. The medium 1 is of a conductive material, and a metal material or the like is applied.

The ink tank 111 is a tank for storing the ink I, and the ink I may be an ink insoluble in a mask removing solvent for removing the mask 120 to be described later. Furthermore, as in the first embodiment, the ink I is an ink containing a charge controlling agent. The medium 1 is immersed in the ink tank 111.

The electrode 112 is disposed inside the ink tank 111 and is disposed to face the medium 1 immersed in the ink I. The electrode 112 may be formed, for example, as a rod-like electrode rod, or when the medium 1 is flat plate shape, it may be formed as a flat plate shaped electrode so as to form a parallel electric field with the medium 1. The electrode 112 is charged to the positive polarity or the negative polarity, and is charged to the same polarity as the polarity of the ink I.

The voltage applying part 113 applies a predetermined voltage Vc to charge the medium 1 to a polarity different from that of the ink I, and charges the electrode 112 to a polarity same as the ink I to generate an electric field between the medium 1 and the electrode 112. For example, when the ink I is a cation (+) ink, the voltage applying part 113 charges the medium 1 to a negative polarity and charges the electrode 112 to a positive polarity.

When printing the medium 1 using the printing apparatus 110, the medium 1 is immersed in the ink tank 111 in which the ink I is stored. Then, the voltage applying part 113 applies a voltage Vc to charge the medium 1 to a polarity different from that of the ink I and to charge the electrode 112 to the same polarity as the ink I. Then, the ink I is electrodeposited on the medium 1, and the medium 1 is electrodeposited with the ink I.

Next, a print method of the medium 1 by electrodeposition coating using the printing apparatus 110 will be described with reference to FIGS. 11 and 12. The print method shown in FIGS. 11 and 12 performs multi-color electrodeposition coating on the medium 1 using a plurality of inks I of different colors. Furthermore, in the print method shown in FIGS. 11 and 12, masking is performed on the medium 1 by printing a predetermined mask 120 on the medium 1 using a mask ink. The mask ink is an ink soluble in the mask removing solvent, and for example, a UV curable ink soluble in an alkaline solution is used.

In the print method shown in FIG. 11, first, electrodeposition coating is performed on the medium 1 by the printing apparatus 110 using the ink I of one color (step S11). After step S11, a mask 120 is formed on the electrodeposited medium 1 using a printing apparatus such as an inkjet printer (step S12). The mask 120 formed on the medium 1 protects the region covered by the mask 120 so that the coating is not performed in the electrodeposition coating to be the post-process. Subsequently, the electrodeposition coating is performed on the medium 1 on which the mask 120 is formed by the printing apparatus 110 using the ink I of one color different from that of step S11 (step S13). Thereafter, the mask 120 formed on the medium 1 is removed using the mask removing solvent (step S14). Thus, the medium 1 becomes the color of the ink I used in step S11 in the region covered by the mask 120, and becomes the color of the ink I used in step S13 in the region other than the region covered by the mask 120. That is, the medium 1 is that which is subjected to the electrodeposition coating of two colors.

Figure 12:
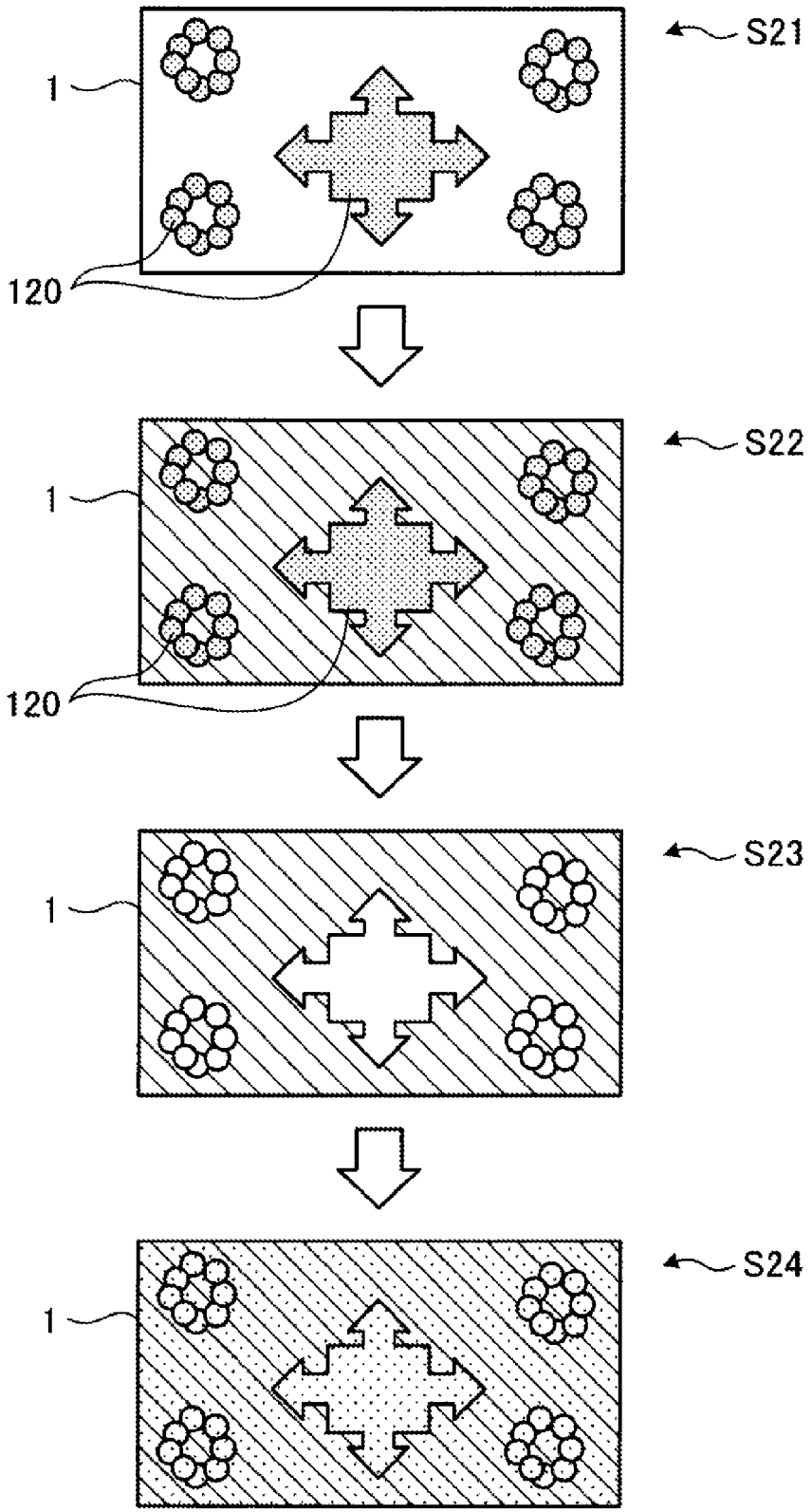
FIG. 12 is an explanatory view related to a print method using electrodeposition coating according to a sixth embodiment.

In the print method shown in FIG. 12, first, the mask 120 is formed on the medium 1 before the electrodeposition coating (step S21). The mask 120 formed on the medium 1 protects the region covered by the mask 120 so that the coating is not performed in the electrodeposition coating to be the post-process. Next, the electrodeposition coating is performed on the medium 1 on which the mask 120 is formed by the printing apparatus 110 using the ink I of one color (step S22). Thereafter, the mask 120 formed on the medium 1 is removed using the mask removing solvent (step S23). Subsequently, the electrodeposition coating is performed on the medium 1 by the printing apparatus 110 using the ink I of one color of a color different from that of step S22 (step S24). Thus, the medium 1 becomes the color of the ink I used in step S24 in the region covered by the mask 120, and becomes a color combining the inks 1 of two colors used in steps S22 and S24 in the region other than the region covered by the mask 120. That is, the medium 1 is that which is subjected to the electrodeposition coating of two colors.

In the print method shown in FIG. 12, for example, the color of the ink I used in step S22 is cyan, and the color of the ink I used in step S24 is yellow. In this case, in the medium 1, the color of the region covered by the mask 120 is yellow, and the color of the region other than the region covered by the mask 120 is green obtained by overlapping cyan and yellow.

In the print method shown in FIGS. 11 and 12, the color to use is not particularly limited, and ink 1 of any color can be used if multi-color electrodeposition coating can be performed on the medium 1.

What is claimed is:

1. A printing apparatus comprising:

an ejection head provided to face a medium, the ejection head being configured to eject an ink containing a charge controlling agent toward the medium as a charged ink droplet to land the charged ink droplet on the medium; and a polarity applier being configured to apply polarity to the medium to have an opposite polarity with respect to a polarity of the charged ink droplet, wherein the ejection head is configured to eject the ink that is a coloring material containing resin-dispersed ink in which particles containing the charge controlling agent and a coloring material in a binder resin are dispersed in a solvent.

2. The printing apparatus according to claim 1, wherein the polarity applier comprises: a first charger, provided to face the medium before the charged ink droplet lands on the medium, the first charger charging the medium to the opposite polarity from the charged ink droplet.

3. The printing apparatus according to claim 2, wherein the first charger is a shield type corona ion charger that generates ions by corona discharge.

4. The printing apparatus according to claim 3, further comprising:

a neutralizer that neutralizes the charged ink droplet and the medium after printing.

5. The printing apparatus according to claim 2, further comprising:

a neutralizer that neutralizes the charged ink droplet and the medium after printing.

6. The printing apparatus according to claim 1, further comprising:

a neutralizer that neutralizes the charged ink droplet and the medium after printing.

7. The printing apparatus according to claim 1, wherein the ejection head is configured to perform an ejection driving by a piezo method.

8. A printing apparatus comprising:

a mounting portion on which a medium is placed;

an ejection head provided to face the medium, the ejection head being configured to eject an ink containing a charge controlling agent toward the medium as a charged ink droplet to land the charged ink droplet on the medium; and a polarity applier being configured to apply polarity to the mounting portion to have an opposite polarity with respect to a polarity of the charged ink droplet, wherein the ejection head is configured to eject the ink that is a coloring material containing resin-dispersed ink in which particles containing the charge controlling agent and a coloring material in a binder resin are dispersed in a solvent.

9. The printing apparatus according to claim 8, wherein the polarity applier comprises: a voltage applying part that applies a voltage between a conductive portion provided in the ejection head and the mounting portion to be conductive to generate an electric field between the ejection head and the mounting portion, thus increasing an abutment force between the medium and the charged ink droplet.

10. The printing apparatus according to claim 9, further comprising:

a neutralizer that neutralizes the charged ink droplet and the medium after printing.

11. The printing apparatus according to claim 8, further comprising:

a neutralizer that neutralizes the charged ink droplet and the medium after printing.

12. The printing apparatus according to claim 8, wherein the ejection head is configured to perform an ejection driving by a piezo method.

13. A printing apparatus comprising:

an ejection head provided to face a medium, the ejection head being configured to eject an ink containing a charge controlling agent toward the medium as a charged ink droplet to land the charged ink droplet on the medium; and a polarity applier being configured to apply polarity to a side of the ejection head to have the same polarity as a polarity of the charged ink droplet, wherein the ejection head is configured to eject the ink that is a coloring material containing resin-dispersed ink in which particles containing the charge controlling agent and a coloring material in a binder resin are dispersed in a solvent.

14. The printing apparatus according to claim 13, wherein the polarity applier comprises: a second charger, provided to face the medium on which the charged ink droplet landed, the second charger charging the medium to the same polarity as the charged ink droplet.

15. The printing apparatus according to claim 14, wherein the second charger is a shield type corona ion charger that generates ions by corona discharge.

16. The printing apparatus according to claim 15, further comprising:

a neutralizer that neutralizes the charged ink droplet and the medium after printing.

17. The printing apparatus according to claim 14, further comprising:

a neutralizer that neutralizes the charged ink droplet and the medium after printing.

18. The printing apparatus according to claim 13, further comprising:

a neutralizer that neutralizes the charged ink droplet and the medium after printing.

19. The printing apparatus according to claim 13, wherein the ejection head is configured to perform an ejection driving by a piezo method.

* * * * *